US006428295B1

(12) United States Patent
Kobayashi et al.

(10) Patent No.: US 6,428,295 B1
(45) Date of Patent: Aug. 6, 2002

(54) SCROLL COMPRESSOR FOR INTRODUCING HIGH-PRESSURE FLUID TO THRUST-FACE SIDE SO AS TO DECREASE THRUST LOAD IMPOSED ON REVOLVING SCROLL

(75) Inventors: Hiroyuki Kobayashi; Makoto Takeuchi; Takahide Itoh, all of Nagoya; Tetsuzuo Ukai, Nishi-kasugai-gun, all of (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 09/985,294

(22) Filed: Nov. 2, 2001

Related U.S. Application Data

(62) Division of application No. 09/588,776, filed on Jun. 7, 2000.

(30) Foreign Application Priority Data

Jun. 8, 1999 (JP) ..... 11-161691
Mar. 6, 2000 (JP) ..... 2000-060915

(51) Int. Cl.[7] ..... F04C 18/04

(52) U.S. Cl. ..... 418/55.5; 418/57; 418/99; 184/6.13; 184/6.16

(58) Field of Search ..... 418/55.5, 57, 99; 184/6.13, 6.16

(56) References Cited

U.S. PATENT DOCUMENTS

| | | | |
|---|---|---|---|
| 4,596,520 | A | 6/1986 | Arata et al. |
| 4,669,962 | A | 6/1987 | Mizuno et al. |
| 6,244,840 | B1 | 6/2001 | Takeuchi et al. |
| 6,287,097 | B1 | 9/2001 | Takeuchi et al. |
| 6,334,764 | B1 | 1/2002 | Kobayashi et al. |

FOREIGN PATENT DOCUMENTS

| | | | |
|---|---|---|---|
| EP | 0534891 A1 | 9/1992 | |
| JP | 04-295194 | * 10/1982 | ..... 418/55.5 |
| JP | 58172401 | 10/1983 | |
| JP | 61237893 | 10/1986 | |
| JP | 04-334781 | * 11/1992 | ..... 418/99 |
| JP | 06-264876 | * 9/1994 | ..... 418/99 |
| JP | 11241691 | 9/1999 | |

OTHER PUBLICATIONS

U.S. application No. 09/588,573, filed Jun. 7, 2000, pending.

U.S. application No. 09/985,493, filed Nov. 5, 2001, pending.

U.S. application No. 192,741, filed Jun. 7, 2000, pending.

U.S. application No. 215,780, filed Nov. 5, 2001, pending.

* cited by examiner

*Primary Examiner*—Thomas Denion
*Assistant Examiner*—Theresa Trieu
(74) *Attorney, Agent, or Firm*—Oblon, Spivak, McClelland, Maier & Neustadt, P.C.

(57) ABSTRACT

A scroll compressor having a simple structure is disclosed, which effectively decreases the thrust load imposed on the revolving scroll without degrading the compression efficiency. The scroll compressor comprises a casing; a fixed scroll provided in the housing and comprising an end plate and a spiral protrusion built on one face of the end plate; and a revolving scroll provided in the casing and comprising an end plate and a spiral protrusion built on one face of the end plate, wherein the spiral protrusions of each scroll are engaged with each other so as to form a spiral compression chamber. In the above structure, an introduced working gas is compressed in the compression chamber and then discharged according to the revolution of the revolving scroll; a thrust member for thrust-supporting the end plate of the revolving scroll is provided at the back-face side of the end plate of the revolving scroll; a pressure pocket is formed in a face of one of the thrust member and the end plate of the revolving scroll, wherein said face faces the other of the thrust member and the end plate of the revolving scroll; and a high-pressure introduction hole for introducing a high-pressure fluid into the pressure pocket is provided at one of the thrust member side and the revolving scroll side.

4 Claims, 7 Drawing Sheets

SCROLL COMPRESSOR FOR INTRODUCING HIGH-PRESSURE FLUID TO THRUST-FACE SIDE SO AS TO DECREASE THRUST LOAD IMPOSED ON REVOLVING SCROLL

This application is a divisional of U.S. application Ser. No. 09/588,776, filed Jun. 7, 2000.

BACKGROUND OF THE INVENTION

1. Field of the Invention

The present invention relates to a scroll compressor, in particular, one suitable for operation in a vapor-compression refrigerating cycle which uses a refrigerant, such as $CO_2$, in a supercritical area thereof.

2. Description of the Related Art

As for the vapor-compression refrigerating cycle, one of the recently proposed measures to avoid the use of Freon (from a refrigerant) in order to protect the environment is the use of a refrigerating cycle using $CO_2$ as the working gas (i.e., the refrigerant gas). This cycle is called "$CO_2$ cycle" below. An example thereof is disclosed in Japanese Examined Patent Application, Second Publication, No. Hei 7-18602. The operation of this $CO_2$ cycle is similar to the operation of a conventional vapor-compression refrigerating cycle using Freon. That is, as shown by the cycle A→B→C→D→A in FIG. 5 (which shows a $CO_2$ Mollier chart), $CO_2$ in the gas phase is compressed using a compressor (A→B), and this hot and compressed $CO_2$ in the gas phase is cooled using a gas cooler (B→C). This cooled gas is further decompressed using a decompressor C→D), and $CO_2$ in the gas-liquid phase is then vaporized (D→A), so that latent heat with respect to the evaporation is taken from an external fluid such as air, thereby cooling the external fluid.

The critical temperature of $CO_2$ is approximately 31° C., that is, lower than that of Freon, the conventional refrigerant. Therefore, when the temperature of the outside air is high in the summer season or the like, the temperature of $CO_2$ at the gas cooler side is higher than the critical temperature of $CO_2$. Therefore, in this case, $CO_2$ is not condensed at the outlet side of the gas cooler (that is, line segment B–C in FIG. 3 does not intersect with the saturated liquid curve SL). In addition, the condition at the outlet side of the gas cooler (corresponding to point C in FIG. 3) depends on the discharge pressure of the compressor and the $CO_2$ temperature at the outlet side of the gas cooler, and this $CO_2$ temperature at the outlet side depends on the discharge ability of the gas cooler and the outside temperature (which cannot be controlled). Therefore, substantially, the $CO_2$ temperature at the outlet side of the gas cooler cannot be controlled. Accordingly, the condition at the outlet side of the gas cooler (i.e., point C) can be controlled by controlling the discharge pressure of the compressor (i.e., the pressure at the outlet side of the gas cooler). That is, in order to keep sufficient cooling ability (i.e., enthalpy difference) when the temperature of the outside air is high in the summer season or the like, higher pressure at the outlet side of the gas cooler is necessary as shown in the cycle E→F→G→H→E in FIG. 3. In order to satisfy this condition, the operating pressure of the compressor must be higher in comparison with the conventional refrigerating cycle using Freon. In an example of an air conditioner used in a vehicle, the operating pressure of the compressor is 3 kg/cm$^2$ in case of using R134 (i.e., conventional Freon), but 40 kg/cm$^2$ in case of $CO_2$. In addition, the operation stopping pressure of the compressor of this example is 15 kg/cm$^2$ in case of using R134, but 100 kg/cm$^2$ in case of $CO_2$.

Here, a general scroll compressor comprises a casing; a fixed scroll and a revolving scroll in the housing, each scroll comprising an end plate and a spiral protrusion built on an inner surface of the end plate, said inner surface facing the other end plate so as to engage the protrusions of each scroll and form a spiral compression chamber. In this structure, the introduced working gas is compressed in the compression chamber and then discharged according to the revolution of the revolving scroll. In such a scroll compressor using $CO_2$ as the working gas and having high operating pressure, the back face of the revolving scroll is supported using a thrust ball bearing so as to put up with or stand up to large thrust imposed on the revolving scroll, so that leakage of the working gas from the compression chamber is prevented as much as possible. As an example, Japanese Unexamined Patent Application, First Publication, Hei 3-54387 discloses supporting the back face of the revolving scroll by using a thrust board and to form a concave portion in a contact face between the thrust board and the revolving scroll so as to seal the relevant part from oil or water. As another example, Japanese Examined Patent Application, Second Publication, Hei 1-44911 discloses the provision of a back pressure chamber at the back face side of the revolving scroll and support of the back face of the revolving scroll by using a piston forced by a spring.

The structure for supporting the revolving scroll using a thrust ball bearing has the following problems: (i) loud noise is generated, and (ii) it is necessary to use a thrust ball bearing having a large diameter so as to secure a sufficiently long life; thus, it is difficult to manufacture a smaller scroll compressor. In addition, in the structure in which the revolving scroll is simply supported using a thrust board, sufficient effect of decreasing thrust loss cannot be obtained.

SUMMARY OF THE INVENTION

In consideration of the above circumstances, the inventors of the present invention diligently continued to research, and discovered that the thrust load can be effectively decreased, preferable lubricating effects can be obtained, and a smaller scroll compressor can be realized without degrading the compression efficiency, based on a simple arrangement such that a high-pressure oil or working gas is introduced from an external supply towards a face (of the thrust board) which faces the revolving scroll. Accordingly, an objective of the present invention is to provide a scroll compressor for effectively decreasing the thrust load imposed on the revolving scroll and improving the mechanical efficiency without degrading the compression efficiency, thereby realizing a simpler and smaller scroll compressor whose maintenance can be easily performed. Therefore, the present invention provides a scroll compressor comprising:

a casing;

a fixed scroll provided in the housing and comprising an end plate and a spiral protrusion built on one face of the end plate; and a revolving scroll provided in the casing and comprising an end plate and a spiral protrusion built on one face of the end plate, wherein the spiral protrusions of each scroll are engaged with each other so as to form a spiral compression chamber, wherein:

an introduced working gas is compressed in the compression chamber and then discharged according to the revolution of the revolving scroll;

a thrust member for thrust-supporting the end plate of the revolving scroll is provided at the back-face side of the end plate of the revolving scroll;

a pressure pocket is formed in a face of one of the thrust member and the end plate of the revolving scroll, wherein said face faces the other of the thrust member and the end plate of the revolving scroll; and a high-pressure introduction hole for introducing a high-pressure fluid into the pressure pocket is provided at one of the thrust member side and the revolving scroll side.

According to the above structure, the high-pressure oil or working gas can be supplied as the high-pressure fluid via an oil supply path and an oil introduction hole (i.e., the high-pressure introduction hole), thereby decreasing the thrust load of the revolving scroll. Therefore, it is possible to prevent noises, and the thrust load imposed on the revolving scroll can be decreased by using the high-pressure fluid for a long period of time, thereby decreasing the mechanical loss. In addition, the scroll compressor according to the present invention can have a simpler structure in comparison with conventional scroll compressors. Thus, the maintenance can be easily performed and a smaller body can be realized.

In order to supply the high-pressure fluid to the pressure pocket, it is possible that a fluid path is formed in the casing; the high-pressure introduction hole is formed in the thrust member, where one end opens and joins the pressure pocket and the other end opens and joins the fluid path in the casing; and a high-pressure fluid is supplied from the compression chamber via the fluid path and the high-pressure introduction hole to the pressure pocket.

In a specific example, a high-pressure fluid supply means is provided for supplying the high-pressure fluid to the fluid path, where the supply means comprises an oil separator for lubricating oil from the discharged high-pressure working gas, and return piping for returning the lubricating oil separated by the oil separator to the fluid path. In this case, the high-pressure oil can be reused.

In another specific example, the high-pressure introduction hole is formed in the end plate of the revolving scroll, where one end opens and joins the pressure pocket and the other end opens and joins the compression chamber; and the working gas in the compression chamber is supplied as a high-pressure fluid via the high-pressure introduction hole to the pressure pocket. Accordingly, the high-pressure fluid in the compression chamber can be supplied to the pressure pocket.

In another specific example, the high-pressure introduction hole is formed in the end plate of the revolving scroll, where one end opens and joins the pressure pocket and the other end opens and joins the compression chamber; and a plurality of compression chambers are provided by engaging the fixed scroll and the revolving scroll, and working gases having different pressures in the compression chambers are supplied as a high-pressure fluid via the high-pressure introduction hole to the pressure pocket. In order to introduce working gases of different pressures to the pressure pocket, a plurality of high-pressure introduction holes may be provided, or a single high-pressure introduction hole may be ramified to form branch holes. Accordingly, preferably combined working gases having different pressures can be introduced into the pressure pocket.

Preferably, the working gas is carbon dioxide. In this case, the present invention can be effectively applied to a scroll compressor which uses a refrigerating cycle using $CO_2$ as the working gas, and which has a high operating pressure.

DESCRIPTION OF THE PREFERRED EMBODIMENTS

Hereinafter, embodiments of the scroll compressor according to the present invention will be explained with reference to the drawings.

Figure 6:
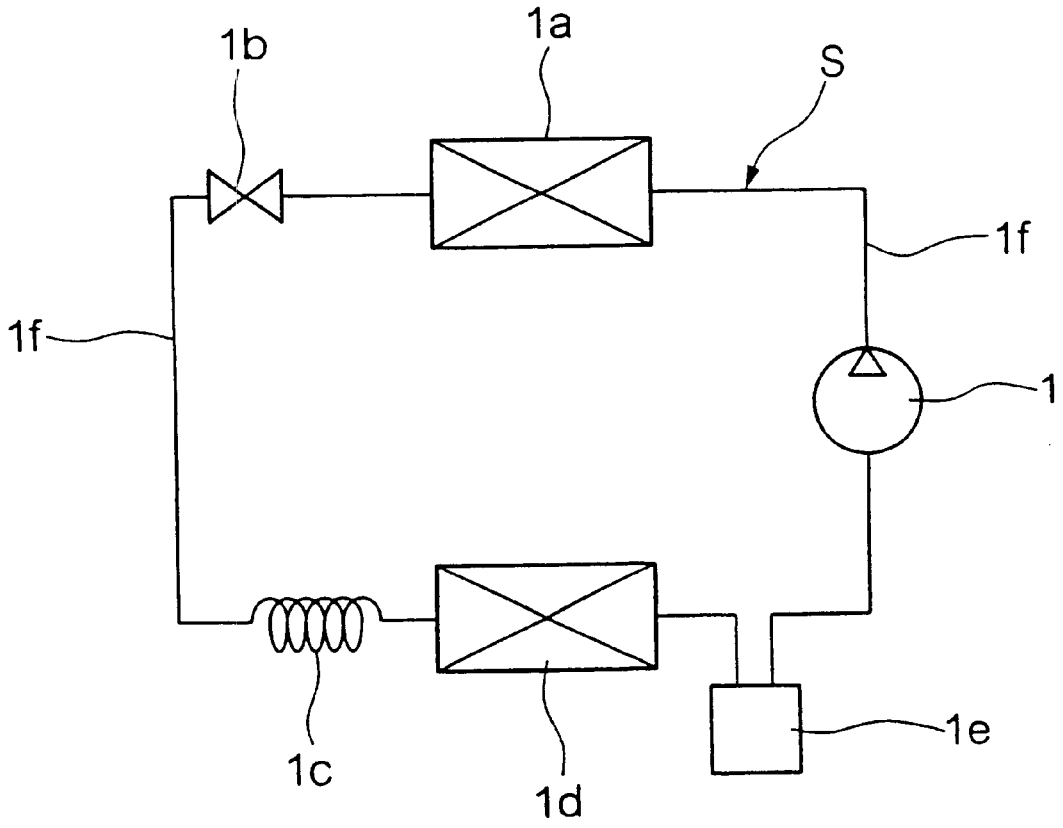
FIG. 6 is a diagram showing a vapour-compression refrigerating cycle.
Figure 7:
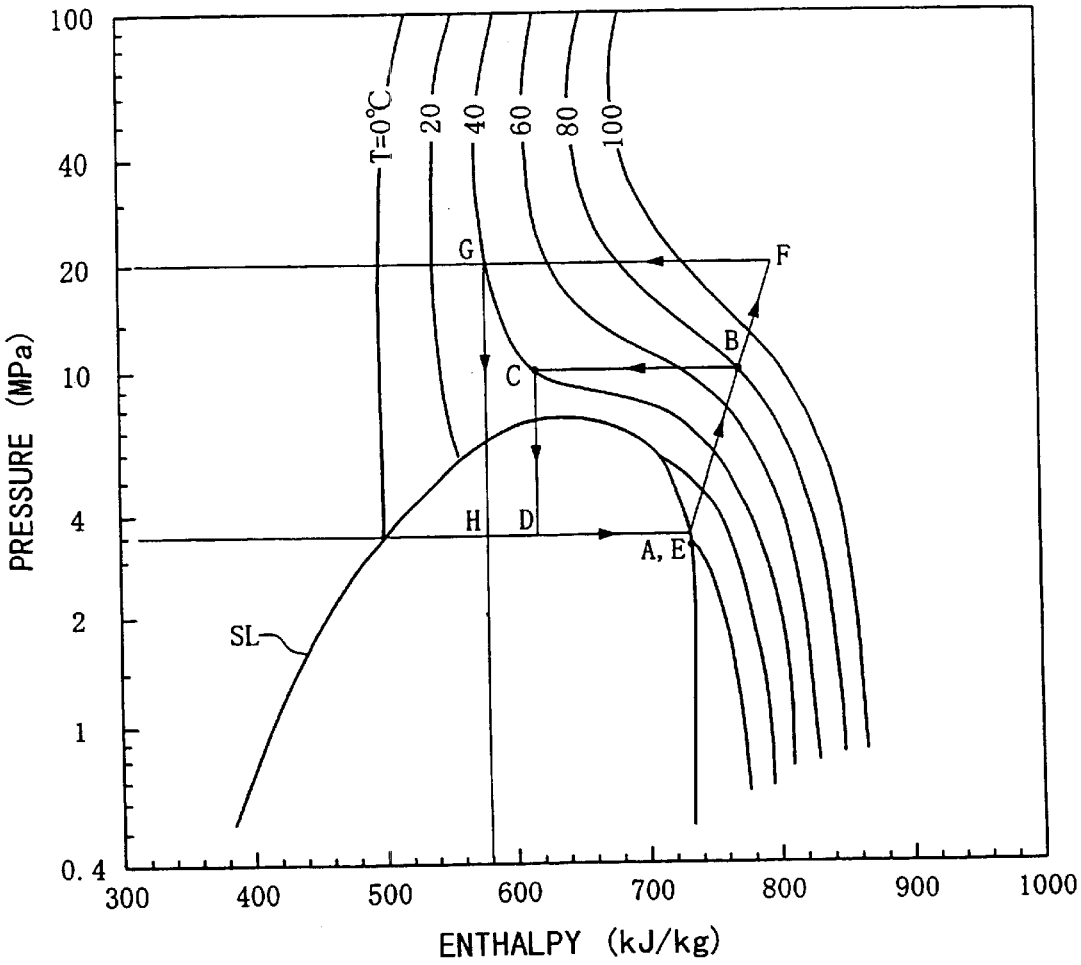
FIG. 7 is a Mollier chart for $CO_2$.

First, the $CO_2$ cycle (structure) including the scroll compressor according to the present invention will be explained with reference to FIG. 6. The $CO_2$ cycle S in FIG. 6 is applied, for example, to the air conditioner of a vehicle. Reference numeral 1 indicates a scroll compressor for compressing $CO_2$ in the gas phase. This scroll compressor 1 receives a driving force from a driving power supply (not shown) such as an engine. Reference numeral 1 a indicates a gas cooler for heat-exchanging $CO_2$ compressed in the scroll compressor 1 and outside air (or the like), so as to cool $CO_2$. Reference numeral 1*b* indicates a pressure control valve for controlling the pressure at the outlet side of the gas cooler 1*a* according to the $CO_2$ temperature at the outlet side of the gas cooler 1*a*. $CO_2$ is decompressed by the pressure control valve 1*b* and restrictor 1*c*, and $CO_2$ enters into the gas-liquid phase (i.e., in the two-phase state). Reference numeral 1*d* indicates an evaporator (i.e., heat absorber) as an air cooling means in the cabin of the vehicle. When $CO_2$ in the gas-liquid two-phase state is vaporized (or evaporated) in the evaporator 1*d*, $CO_2$ takes heat (corresponding to the, latent heat of $CO_2$) from the air in the cabin so that the air in the cabin is cooled. Reference numeral 1*e* indicates an accumulator for temporarily storing $CO_2$ in the gas phase. The scroll compressor 1, gas cooler 1*a*, pressure control valve 1*b*, restrictor 1*c*, evaporator 1*d*, and accumulator 1*e* are connected via piping 1*f* so as to form a closed circuit.

The first embodiment of the scroll compressor 1 will be explained with reference to FIG. 1.

Housing (or casing) 1A of scroll compressor 1 includes cup-like main body 2, and front case (i.e., crank case) 4 fastened to the main body 2 via bolt 3. Reference numeral 5 indicates a crank shaft which pierces the front case 4 and is supported via main bearing 6 and sub bearing 7 by the front case 4 in a freely-rotatable form. The rotation of the engine (not shown) of the vehicle is transmitted via a known electromagnetic clutch 32 to the crank shaft 5. Reference numerals 32*a* and 32*b* respectively indicate the coil and pulley of the electromagnetic clutch 32.

In the housing 1A, fixed scroll 8 and revolving scroll 9 are provided.

The fixed scroll 8 comprises end plate 10 and spiral protrusion (i.e., lap) 11 disposed on a surface of the plate 11, and the surface facing end plate 17 explained later. A ring-shaped back pressure block 13 is detachably attached to the back face of end plate 10 by using a plurality of bolts 12 as fastening means. O rings 14*a* and 14*b* are provided (or embedded) in the inner-peripheral and outer-peripheral faces of the back pressure block 13. These O rings 14*a* and 14*b* closely contact the inner-peripheral face of main body 2 of the casing, and high-pressure chamber (discharge chamber, explained later) 16 is separated from low-pressure chamber 15 (suction chamber) in the main body 2 of the casing. The high-pressure chamber 16 consists of a space surrounded by smaller-diameter face 13*a* of the back pressure block 13, a space surrounded by larger-diameter face 13*b* of the back pressure block 13, this space being formed continuously with the above space surrounded by face 13*a*, and a space surrounded by concave portion 10*a* formed in the back face of the end plate 10 of fixed scroll 8, this space being formed continuously with the above space surrounded by face 13*b*. In the end plate 10 of fixed scroll 8, discharge port 34 (i.e., top clearance) is opened, and discharge valve 35 for opening/closing this discharge port 34 is provided in the concave portion 10*a*.

The revolving scroll 9 comprises end plate 17 and spiral protrusion (i.e., lap) 18 which is disposed on a surface of the plate 17, the surface facing the end plate 10. The shape of the spiral protrusion 18 is substantially the same as that of the spiral protrusion 11 of the fixed scroll 8.

A ring-shaped plate spring 20*a* is provided between the fixed scroll 8 and the main body 2 of the casing. A plurality of predetermined positions of the plate spring 20*a* are alternately fastened to the fixed scroll 8 and to the main body 2 via bolts 20*b*. According to this structure, the fixed scroll 8 can move only in its axial direction by the (amount of) maximum flexure of plate spring 20*a* in the axial direction (i.e., a floating structure). The above ring-shaped plate springs 20*a* and bolts 20*a* form fixed scroll supporting apparatus (or axial-direction compliance supporting apparatus) 20. Between the portion protruding from the back face of the back pressure block 13 and housing 1 A, gap C is provided, so that the back pressure block 13 can move in the axial direction described above. The fixed scroll 8 and the revolving scroll 9 are engaged in a manner such that the axes of these scrolls are eccentrically separated from each other by the radius of revolution (that is, in an eccentric form), and the phases of these scrolls differ from each other by 180° (refer to FIG. 1). In addition, the head surface of spiral protrusion 11 is in close contact with the inner surface (facing the end plate 10) of end plate 17, while the head surface of spiral protrusion 18 is in close contact with the inner surface (facing the end plate 17) of end plate 10. Furthermore, the side faces of the spiral protrusions 11 and 18 contact each other at some positions so that enclosed spaces 21*a* and 21*b* are formed essentially at positions of point symmetry with respect to the center of the spiral. In addition, rotation-preventing ring (i.e., Oldham coupling) 27 for permitting the revolving scroll 9 to revolve, but prohibiting the rotation of the scroll 9, is provided between the fixed scroll 8 and revolving scroll 9.

As explained above, discharge port (i.e., top clearance) 34 is formed only in the end plate 10 of fixed scroll 8, and discharge valve 35 for opening/closing the discharge port 34 is directly attached to the end plate 10 of fixed scroll 8. Therefore, it is unnecessary to form discharge port 34 in the back pressure block 13, thereby decreasing the length and volume of the discharge port 34. Accordingly, lower recompressive force of the compressor is necessary, thereby improving the operational ability.

In addition, back pressure block 13 and fixed scroll 8 have separate bodies, and the back pressure block 13 is detachably attached to the fixed scroll 8 using bolts 12 (i.e., fastening means). In this structure, it is possible to easily attach discharge valve 35 to the end plate 10 of fixed scroll 8 before the back pressure block 13 is attached to the fixed scroll 8, and the place of attachment is less limited.

A boss 22 is provided on (or projects from) a central area of the outer surface of the end plate 17. A freely-rotatable drive bush 23 is inserted in the boss 22 via revolving bearing (or drive bearing) 24 which also functions as a radial bearing. In addition, a freely-rotatable eccentric shaft 26, projecting from the inner-side end of the crank shaft 5, is inserted in through hole 25 provided in the drive bush 23. Furthermore, thrust board (i.e., thrust member, explained later) 19 for thrust-supporting the revolving scroll 9 is provided between the outer-circumferential edge of the outer surface of end plate 17 and the front case 4.

A known mechanical seal (i.e., shaft seal) 28 used for sealing a shaft is provided around the crank shaft 5, and this mechanical seal 28 comprises seat ring 28*a* fixed to the front case 4, and slave ring 28*b* which rotates together with crank shaft 5. This slave ring 28*b* is forced by forcing member 28*c* towards seat ring 28*a* and closely contacts the seat ring 28*a*, so that the slave ring 28*b* rotationally slides on the seat ring 28*a* in accordance with the rotation of the crank shaft 5.

The distinctive portion of the present embodiment will be explained below.

Figure 1:
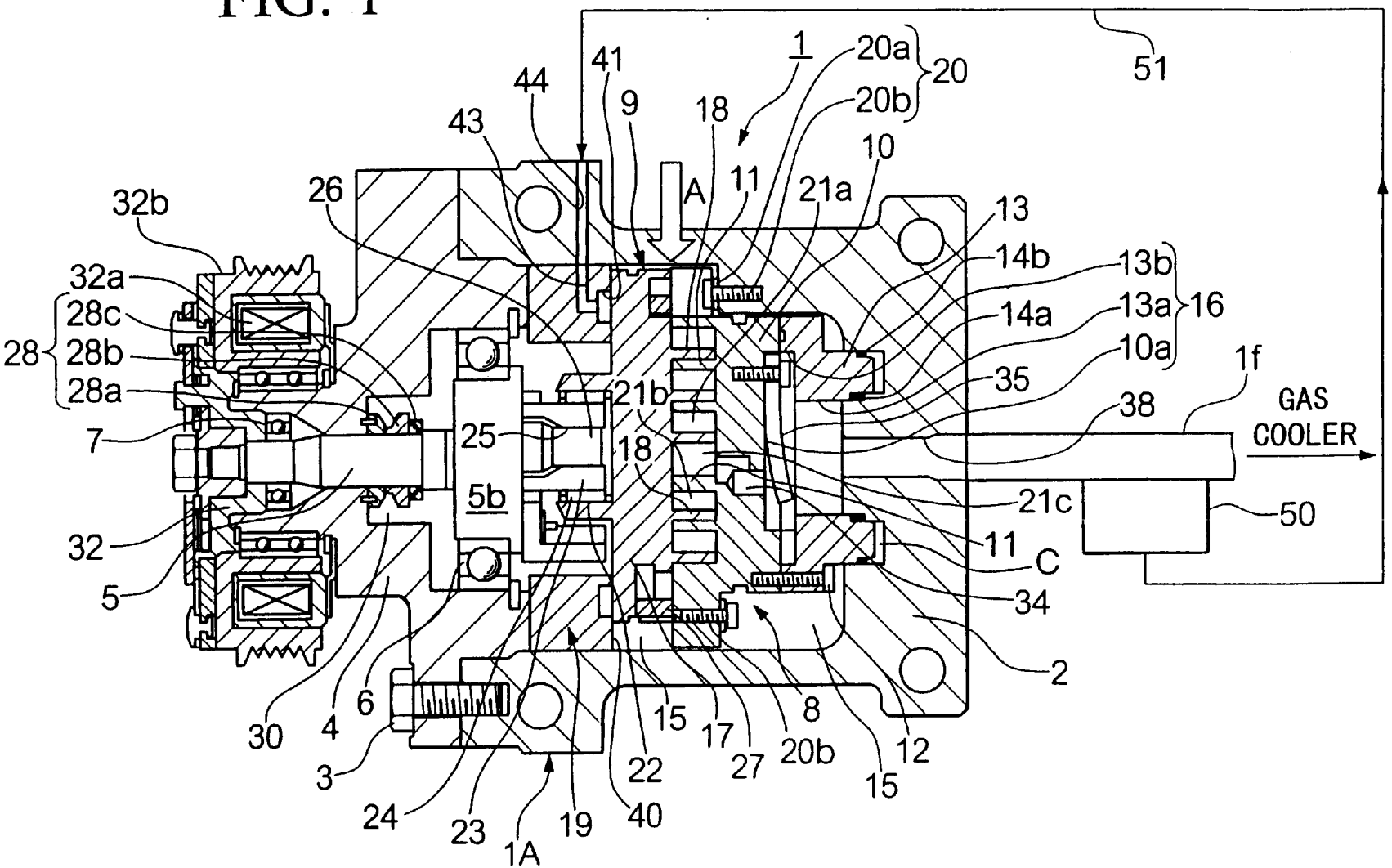
FIG. 1 is a cross-sectional view in the longitudinal direction of an embodiment of the scroll compressor according to the present invention.
Figure 2:
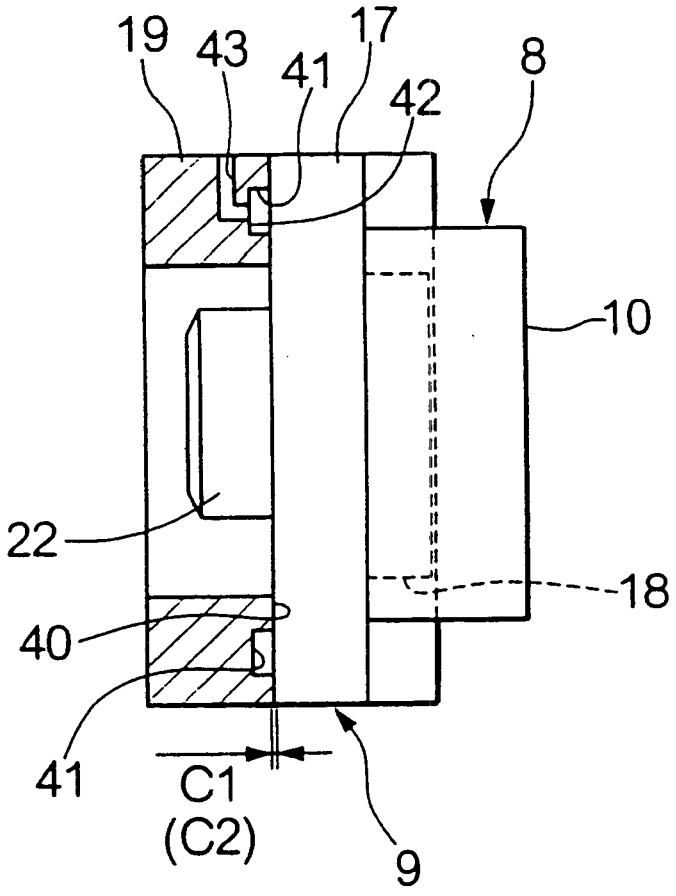
FIG. 2 is an enlarged view of the vicinity of the thrust board shown in FIG. 1.

As shown in FIGS. 1 and 2, a ring-shaped thrust board 19 is provided at the back side of the revolving scroll 9. The thrust board 19 is close to and faces the end plate 17 of the revolving scroll 9, and is attached to an end face of the front casing 4. A ring-shaped pressure pocket 41 is opened in thrust face 40 of thrust board 19 (i.e., the face 40 at the end plate 17 side of revolving scroll 19), and high-pressure introduction hole 43 for introducing high-pressure oil into the pressure pocket 41 is opened from back face 42 of the pressure pocket 41. This high-pressure introduction hole 43 is an L-shaped path which passes through the thrust board 19. An oil supply path (i.e., fluid path) 44 joining the high-pressure introduction hole 43 is formed in main body 2 of housing (i.e., casing) 1A.

As shown in FIG. 1, an oil separator 50 is attached to piping 1*f* connected to discharge outlet 38 of scroll compressor 1. This oil separator 50 is provided for separating lubricating oil (i.e., high-pressure oil) as a high-pressure fluid from the discharged working gas, and the separated lubricating oil is supplied to the oil supply path 44 via return piping 51. That is, according to the operation of the scroll compressor 1, lubricating oil is supplied into the scroll compressor 1 by a supply means (not shown), and the oil component included in the high-pressure working gas which is discharged from the discharge outlet 38 is filtered out when the working gas passes through the oil separator 50. The gathered lubricating oil is introduced as high-pressure oil via return piping 51, oil supply path 44, and high-pressure introduction hole 43 into pressure pocket 41, so that the pocket is filled with the high-pressure oil.

The operation of the scroll compressor 1 will be explained below.

When the rotation of the vehicle engine is transmitted to the crank shaft 5 by energizing the coil 32*a* of the electromagnetic clutch 32, the revolving scroll 9 is driven by the rotation of the crank shaft 5, transmitted via the revolution driving mechanism consisting of eccentric shaft 26, through hole 25, drive bush 23, revolving bearing 24, and boss 22. The revolving scroll 9 revolves along a circular orbit having a radius of revolution, while rotation of the scroll 9 is prohibited by the rotation-preventing ring 27.

In this way, line-contact portions in the side faces of spiral protrusions 11 and 18 gradually move toward the center of the "swirl", and thereby enclosed spaces (i.e., compression chambers) 21*a* and 21*b* also move toward the center of the swirl while the volume of each chamber is gradually reduced.

Accordingly, the working gas (refer to arrow A), which has flowed into suction chamber 15 through a suction inlet (not shown), enters enclosed space 21*a* from an opening at the ends of the spiral protrusions 11 and 18 and reaches center space 21*c* of the compression chambers while the gas is compressed. The compressed gas then passes through discharge port 34 provided in the end plate 10 of the fixed scroll 8, and opens discharge valve 35, so that the gas is discharged into high-pressure chamber 16. The gas is further discharged outside via discharge outlet 38. In this way, according to the revolution of the revolving scroll 9, the fluid introduced from the suction chamber 15 is compressed in the enclosed spaces 21*a* and 21*b*, and this compressed gas is discharged.

When the energizing process for coil 32*a* of electromagnetic clutch 32 is released so as to stop transmission of the rotating force to crank shaft 5, the operation of the scroll compressor 1 is stopped. When the coil 32*a* of electromagnetic clutch 32 is energized again, the scroll compressor 1 is activated again.

The oil component of the high-pressure working gas discharged from the discharge outlet 38 is filtered out when the working gas passes through oil separator 50. The gathered lubricating oil is supplied as high-pressure oil via return piping 51 to oil supply path 44, and this supplied high-pressure oil passes through high-pressure introduction hole 43 into pressure pocket 41, so that the pocket is filled with the high-pressure oil. The revolving scroll 9 is uniformly thrust-supported by the function of the high-pressure oil, so that the thrust load imposed on the revolving scroll 9 can be decreased.

That is, given area A of the opening of pressure pocket 41, pressure R of the high-pressure oil in the pressure pocket 41, and thrust area $A_{th}$ in the solid-contact state, the decreased thrust (force) $F_{oil}$ can be defined as:

$$F_{oil} = A \times R + A_{th} \times \frac{1}{2} R$$

In addition, given back pressure $F_z$ which fixed scroll 8 receives from the back pressure block 13, thrust load $F_s$ on the revolving scroll 9 is decreased to "$F_z - F_{oil}$".

In FIG. 2, gap C1 between the thrust board 19 and end plate 17 of revolving scroll 9 is set to be, for example, a few $\mu$m to a few ten $\mu$m, where the oil leaked from pressure pocket 41 through gap C1 is used as the lubricating oil.

As explained above, in the present embodiment, high-pressure oil is supplied from an external supply via oil supply path 44 and introduction hole 43 to pressure pocket 41. Therefore, it is possible to prevent noises, and the thrust load imposed on the revolving scroll 9 can be decreased by using the high-pressure oil for a long period of time without degrading the compression efficiency, thereby decreasing the mechanical loss. In addition, the present scroll compressor has a simpler structure in comparison with conventional scroll compressors; thus, maintenance can be easily performed and a smaller body can be realized.

Furthermore, the oil leaked from the pressure pocket 41 lubricates the inside of the scroll compressor 1. In addition, the structure of the present embodiment comprises oil separator 50 (functioning as the high-pressure fluid supply means) for separating the lubricating oil from the high-pressure working gas, and lubricating oil return piping 51 for returning the lubricating oil separated by the oil separator 50; therefore, the high-pressure oil can be reused.

Below, the second embodiment of the scroll compressor according to the present invention will be explained.

Figure 3:
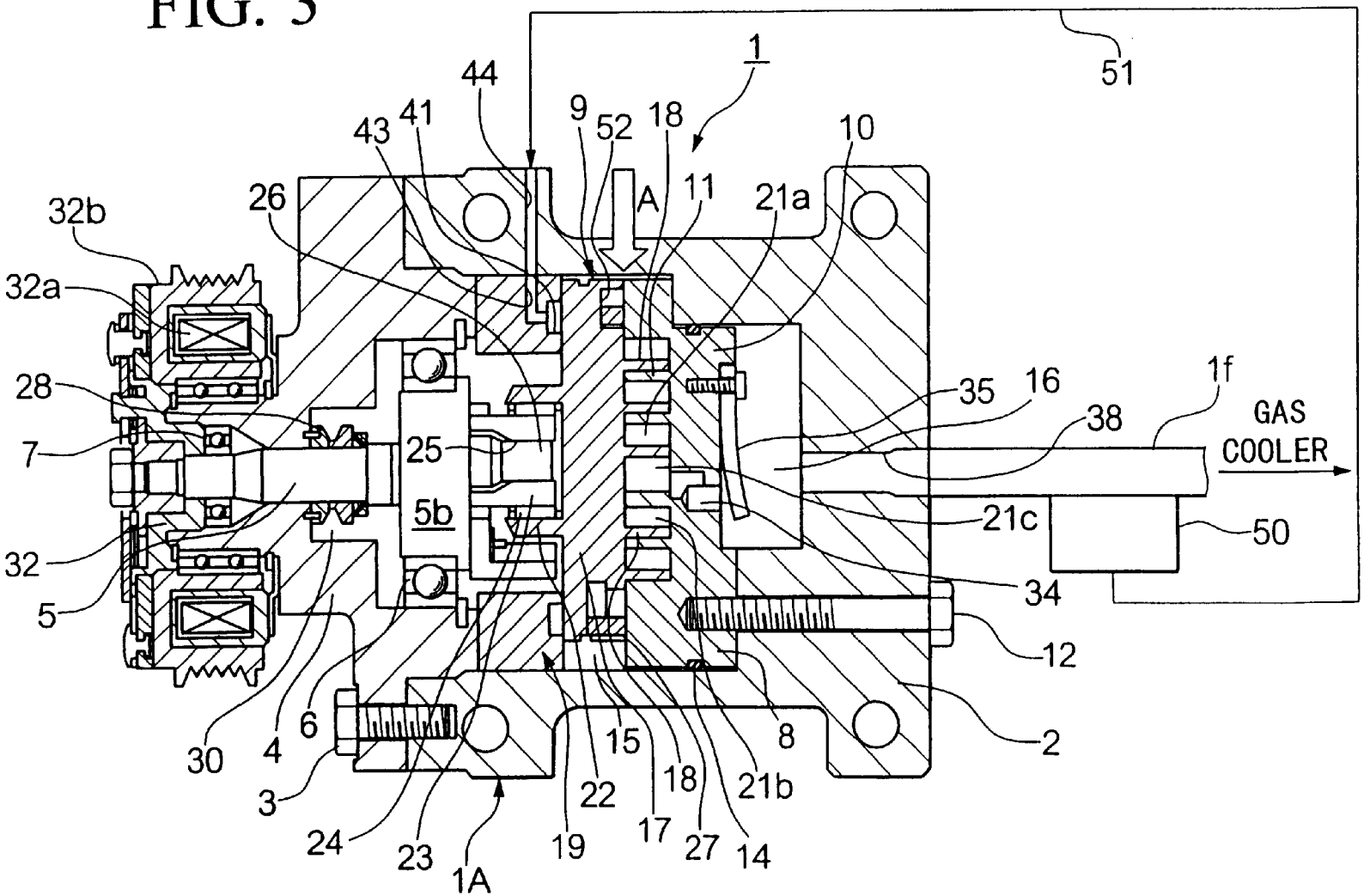
FIG. 3 is a cross-sectional view in the longitudinal direction of another embodiment of the scroll compressor according to the present invention.

In the scroll compressor as shown in FIG. 1, the fixed scroll 8 can move in its axial direction (i.e., a floating structure), and back pressure is provided to the fixed scroll by using back pressure block 13. However, as shown in FIG. 3, the second embodiment has a non-floating structure in which the fixed scroll 8 is rigidly fixed to casing main body 2 by using bolt 12, and no back pressure block is provided. O ring 14 is provided and embedded in the outer-peripheral face of end plate 10 of the fixed scroll 10, thereby dividing the inside space of casing 2 into low-pressure chamber 15 and high-pressure chamber 16.

In the second embodiment, gap C2 (refer to FIG. 2) between the thrust board 19 and the end plate 17 of the revolving scroll 9 is smaller than gap C1 (also refer to FIG. 2) in the first embodiment, more specifically, C2 is approximately a few $\mu$m to 20 $\mu$m, so that leakage of high-pressure oil from gap C2 is prevented as much as possible. The other structural arrangements are the same as those shown in FIGS. 1 and 2, and explanations thereof are omitted.

With $F_{th}$ for separating the fixed scroll 8 and revolving scroll 9, the pressure of the high-pressure oil and the area of the opening of the pressure pocket 41 are determined so as to satisfy the condition "$F_{oil}$ (decreased thrust)>$F_{th}$" and to cope with the relevant (or whole) thrust load.

In addition, if tip seals (not shown) are provided and buried at the head surface of each spiral protrusion (i.e., tip head) of the fixed and revolving scrolls, the increase of loss due to leakage from the chip head can be prevented. In this case, the above condition "$F_{oil}$>$F_{th}$" is not always necessary, and it is possible to prevent the oil leakage and also to decrease the thrust load.

Accordingly, effects similar to those obtained by the first embodiment can also be obtained in the second embodiment.

The pressure pocket 41 of the thrust board 19 has a ring-shaped structure; thus, if the (surface) accuracy of thrust face 40 of the thrust board 19 is partially degraded, the high-pressure oil excessively leaks from the corresponding portion of the pressure pocket 41, and in such a case, the high-pressure oil may not be kept in the pressure pocket 41.

Figure 4A:
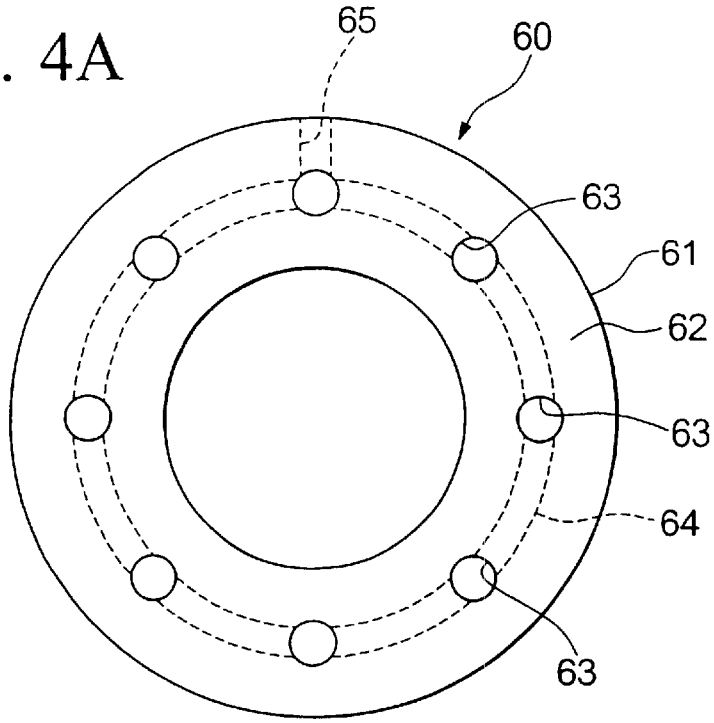
FIGS. 4A and 4B are side and cross-sectional views of another example of the thrust board.
Figure 4B:
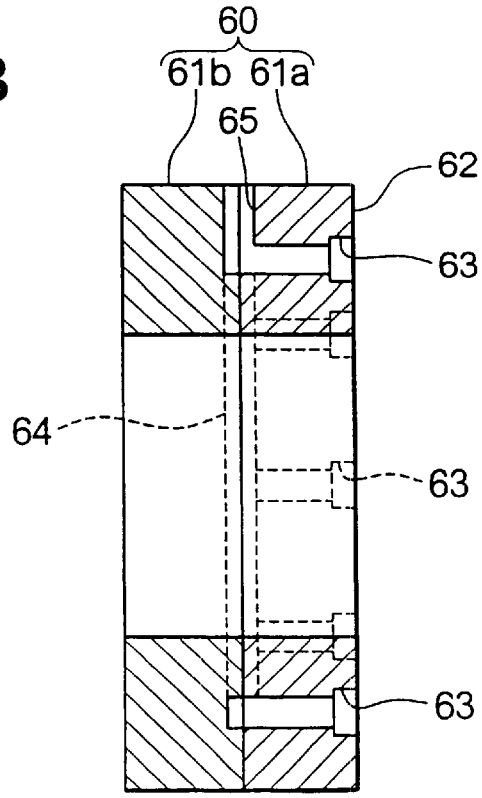

In order to solve the above problem, the following structure is effective. As shown in FIGS. 4A and 4B, the thrust board 60 consists of two portions divided in the thickness direction, such as thrust-face side member 61*a* at the thrust face side, and anti-thrust-face side member 61*b* at the side opposed to the thrust face. In the thrust face 62 of the thrust-face side member 61*a*, a plurality of (e.g., 8) separate pressure pockets are formed in a circumferential direction, and circular path 64 for connecting the pressure pockets with each other is formed at a conjunction area of the members 61*a* and 61*b*. A high-pressure introduction hole 65 which opens in the outer-peripheral surface of the thrust board 60 is also formed at the conjunction area of the members 61*a* and 61*b*, where the introduction hole 65 joins the path 64. The thrust-face and anti-thrust-face side members 61*a* and 61*b* are combined, for example, by welding, so that the thrust board 60 is formed. According to the above structure, even if the accuracy of the thrust face 62 of the thrust board 60 is partially degraded, excessive leakage of the high-pressure oil may occur only through a corresponding pressure pocket 63, while sufficient high-pressure oil can be kept in the other pressure pockets, so that excessive leakage does not easily occur.

In the above first and second embodiments, lubricating oil return piping 51 may be omitted, and instead, a high-pressure oil tank for storing high-pressure oil may be provided so as to supply the high-pressure oil through the piping to the oil supply path 44.

In addition, in the above-explained structure, the lubricating oil separated from the working gas by the oil separator 50 is supplied as the high-pressure fluid to the pressure pocket 41; however, a portion of the working gas discharged from the discharge outlet 38 may be introduced via the oil supply path 44 and high-pressure introduction hole 43 to the pressure pocket 41. Furthermore, a medium-pressure element may be introduced from the compression chambers to the pressure pocket 41.

Also in these cases, noises can be prevented and the thrust imposed on the revolving scroll 9 can be decreased, thereby decreasing the mechanical loss.

Below, the third embodiment according to the present invention will be explained.

Figure 5:
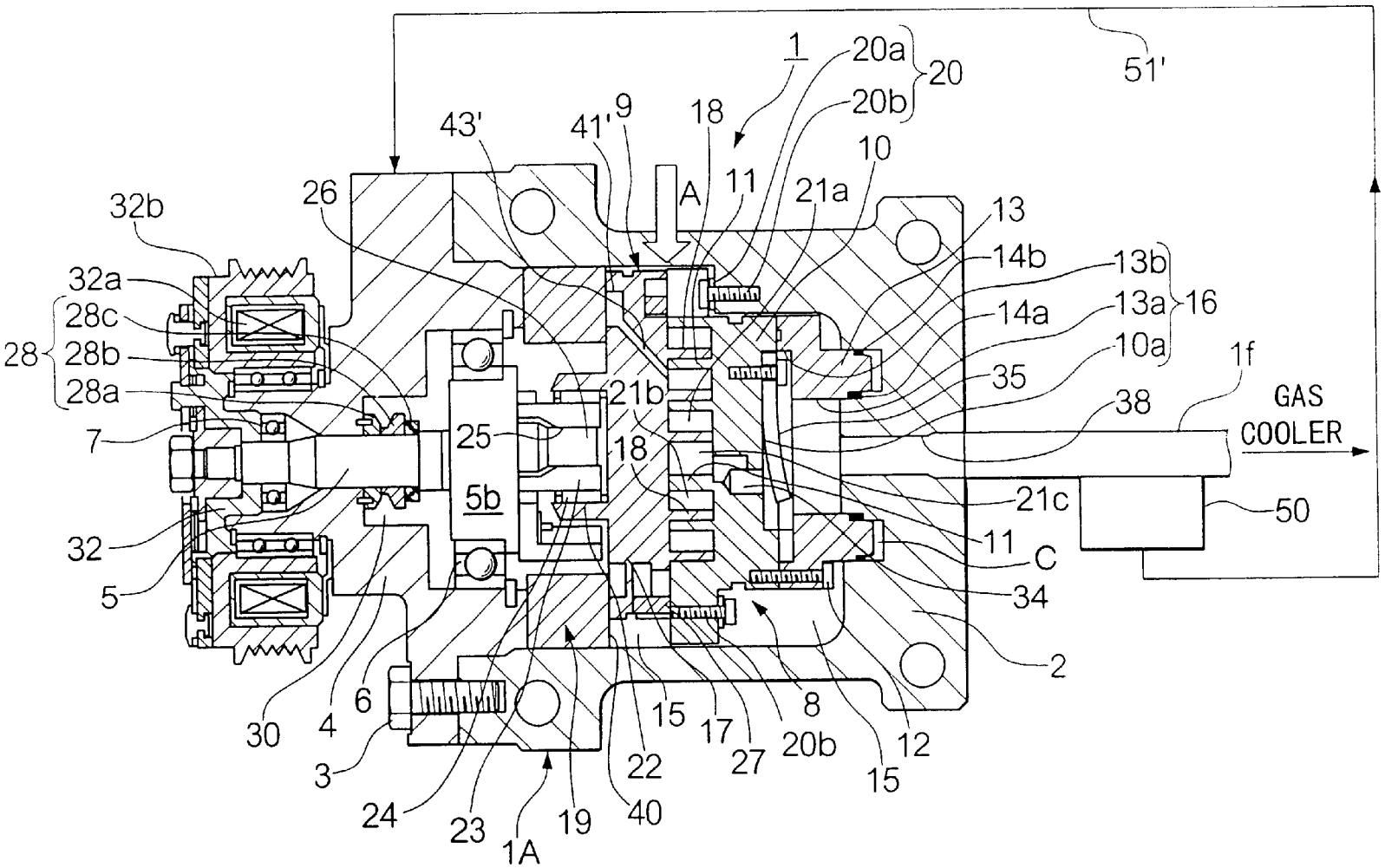
FIG. 5 is a cross-sectional view in the longitudinal direction of another embodiment of the scroll compressor according to the present invention.

In the scroll compressor as shown in FIG. 5, a ring-shaped pressure pocket 41' is formed on a side face of end plate 17 of the revolving scroll 9, where the side face contacts the thrust board 19. A high-pressure introduction hole 43' for supplying the compressed gas to the pressure pocket 41' is provided, which joins the pressure pocket 41'. The other opening end of the high-pressure introduction hole 43' joins the enclosed space 21*a* or 21*b* at the spiral protrusion 18 side of the end plate 17. The other structural arrangements are the same as those of the first embodiment as shown in FIG. 1, and explanations thereof are omitted.

In the scroll compressor of the third embodiment, a portion of the compressed gas in the enclosed space 21*a* or 21*b* is supplied via the high-pressure introduction hole 43' to the pressure pocket 41', and the compressed gas functioning as the high-pressure fluid receives a portion of the thrust load. Therefore, as in the above (first and second) embodiments explained above, noises can be prevented, and the thrust load imposed on the revolving scroll 9 can be decreased by using the compressed gas for a long period of time, thereby decreasing the mechanical loss. In addition, the present scroll compressor has a simpler structure in comparison with conventional scroll compressors; thus, the maintenance can be easily performed and a smaller body can be realized.

In addition, the lubricating oil carried with the compressed gas leaked from the pressure pocket 41' lubricates the inside of the scroll compressor 1.

In order to exert a larger load on the compressed gas, preferably, the opening area of the pressure pocket 41' is increased as much as possible.

In the third embodiment, the other end of the high-pressure introduction hole 43' is open towards enclosed space 21*a* or 21*b*, that is, one enclosed space; however, the high-pressure introduction hole may be open towards a plurality of enclosed spaces 21*a* and 21*b* so that working gases having different pressures are introduced into the pressure pocket 41'. In order to realize such a structure, a plurality of high-pressure introduction holes may be provided, or a single high-pressure introduction hole may be ramified to form branch holes. Accordingly, preferably combined working gases having different pressures can be introduced into the pressure pocket 41'.

In the above embodiments, pressure pockets 41, 63 and 41' may be formed at either side of the revolving scroll 9 and the thrust board 19. That is, in the first and second embodiments, pressure pockets 41 and 63 are formed in the thrust board 19; however, the pockets may be provided in the revolving scroll 9. On the other hand, in the third embodiment, the pressure pocket 41' is formed in the revolving scroll 9, but may be formed in the thrust board 19.

In the above explained embodiments, the scroll compressor is applied to the $CO_2$ cycle using $CO_2$ as the working gas; however, the application is not limited to this type, and the compressor according to the present invention can be applied to the vapor-compression refrigerating cycle using a conventional working gas such as Freon.

What is claimed is:

1. A scroll compressor comprising:

a casing;

a fixed scroll provided in the housing and comprising an end plate and a spiral protrusion built on one face of the end plate; and a revolving scroll provided in the casing and comprising an end plate and a spiral protrusion built on one face of the end plate, wherein the spiral protrusions of each scroll are engaged with each other so as to form a spiral compression chamber, wherein:

an introduced working gas is compressed in the compression chamber and then discharged according to the revolution of the revolving scroll;

a thrust member for thrust-supporting the end plate of the revolving scroll is provided at the back-face side of the end plate of the revolving scroll;

a pressure pocket is formed in a face of the end plate of the revolving scroll, wherein said face faces the thrust member; and a high-pressure introduction hole for introducing a high-pressure fluid into the pressure pocket is provided at the revolving scroll side.

2. A scroll compressor as claimed in claim 1, wherein:

the high-pressure introduction hole is formed in the end plate of the revolving scroll, where one end opens and joins the pressure pocket and the other end opens and joins the compression chamber; and the working gas in the compression chamber is supplied as a high-pressure fluid via the high-pressure introduction hole to the pressure pocket.

3. A scroll compressor as claimed in claim 1, wherein:

the high-pressure introduction hole is formed in the end plate of the revolving scroll, where one end opens and joins the pressure pocket and the other end opens and joins the compression chamber; and a plurality of compression chambers are provided by engaging the fixed scroll and the revolving scroll, and working gases having different pressures in the compression chambers are supplied as a high-pressure fluid via the high-pressure introduction hole to the pressure pocket.

4. A scroll compressor as claimed in any one of claims 1, 2, and 3, wherein the working gas is carbon dioxide.

* * * * *

UNITED STATES PATENT AND TRADEMARK OFFICE

CERTIFICATE OF CORRECTION

PATENT NO. : 6,428,295 B1
DATED : August 6, 2002
INVENTOR(S) : Kobayashi et al.

It is certified that error appears in the above-identified patent and that said Letters Patent is hereby corrected as shown below:

Title page,
Item [75], the Inventor information is incorrect. It should read:

-- [75] Inventors: Hiroyuki Kobayashi Makoto Takeuchi; Takahide Itoh, all of Nagoya; Tesuzou Ukai, Nishi-kasugai-gun, all of (JP) --

Signed and Sealed this

First Day of July, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,428,295 B1
DATED : August 6, 2002
INVENTOR(S) : Kobayashi et al.

It is certified that error appears in the above-identified patent and that said Letters Patent is hereby corrected as shown below:

Title page,
Item [75], Inventors, should read:
-- [75] Inventors: Hiroyuki Kobayashi; Makoto Takeuchi; Takahide Itoh, all of Nagoya; Tetsuzou Ukai, Nishi-kasugai-gun, all of (JP) --

Signed and Sealed this

Seventeenth Day of August, 2004

JON W. DUDAS
*Acting Director of the United States Patent and Trademark Office*